US006502899B2

(12) United States Patent
Tseng

(10) Patent No.: US 6,502,899 B2
(45) Date of Patent: Jan. 7, 2003

(54) CHAIR HAVING AN ARMREST WITH A DETACHABLE FACE PANEL

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/814,882

(22) Filed: Mar. 22, 2001

(65) Prior Publication Data

US 2002/0135210 A1 Sep. 26, 2002

(51) Int. Cl.[7] ..... A47C 4/46

(52) U.S. Cl. ..... 297/28; 297/39; 297/359; 297/452.38

(58) Field of Search ..... 297/28, 35, 39, 297/188.14, 452.38, 463.2, 359

(56) References Cited

U.S. PATENT DOCUMENTS 3,099,478 A * 7/1963 Pearlstine ..... 297/28
4,898,421 A * 2/1990 Brunn ..... 297/28
5,302,000 A * 4/1994 Ayotte ..... 297/188.14
5,924,769 A * 7/1999 Kao ..... 297/452.38
6,283,551 B1 * 9/2001 Bergin ..... 297/188.14

* cited by examiner

*Primary Examiner*—Peter R. Brown
(74) *Attorney, Agent, or Firm*—Ladas & Parry

(57) ABSTRACT

A chair includes a backrest member, a seat member and a pair of armrest members. The backrest member has opposite lateral sides, upper and lower ends, and an intermediate portion between the upper and lower ends. The seat member has a rear end pivoted to the lower end of the backrest member. The armrest members are disposed on the lateral sides of the backrest member. Each of the armrest members has a rear end pivoted to the intermediate portion of the backrest member, and an outer wall surface formed with a mounting recess. Each of the armrest members includes a face panel disposed fittingly and detachably in the mounting recess.

5 Claims, 4 Drawing Sheets

CHAIR HAVING AN ARMREST WITH A DETACHABLE FACE PANEL

BACKGROUND OF THE INVENTION

1. Field of the Invention

The present invention relates to a chair, more particularly to a chair having an armrest with a detachable decorative face panel so as to provide the chair with a changeable appearance.

2. Description of the Related Art

A conventional chair generally has a backrest member, a seat member having a rear end connected to the backrest member, a pair of armrest members having rear ends connected to the backrest member at opposite lateral sides of the backrest member, and front and rear legs. One possible way of changing the appearance of the armrest members is to attach a decorative patch thereon. However, an unpleasant appearance would be left on the armrest member when the patch is removed or when the patch has been put on the armrest member for a long period of time. It is desirable to provide a chair having an armrest member with a changeable appearance for enhanced consumer appeal.

SUMMARY OF THE INVENTION

Therefore, the main object of the present invention is to provide a chair having an armrest with a detachable decorative face panel so as to provide a changeable appearance to the chair.

Accordingly, the chair of the present invention includes a backrest member, a seat member and a pair of armrest members. The backrest member has opposite lateral sides, upper and lower ends, and an intermediate portion between the upper and lower ends. The seat member has a rear end pivoted to the lower end of the backrest member. The armrest members are disposed on the lateral sides of the backrest member. Each of the armrest members has a rear end pivoted to the intermediate portion of the backrest member, and an outer wall surface formed with a mounting recess. Each of the armrest members includes a face panel disposed fittingly and detachably in the mounting recess.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
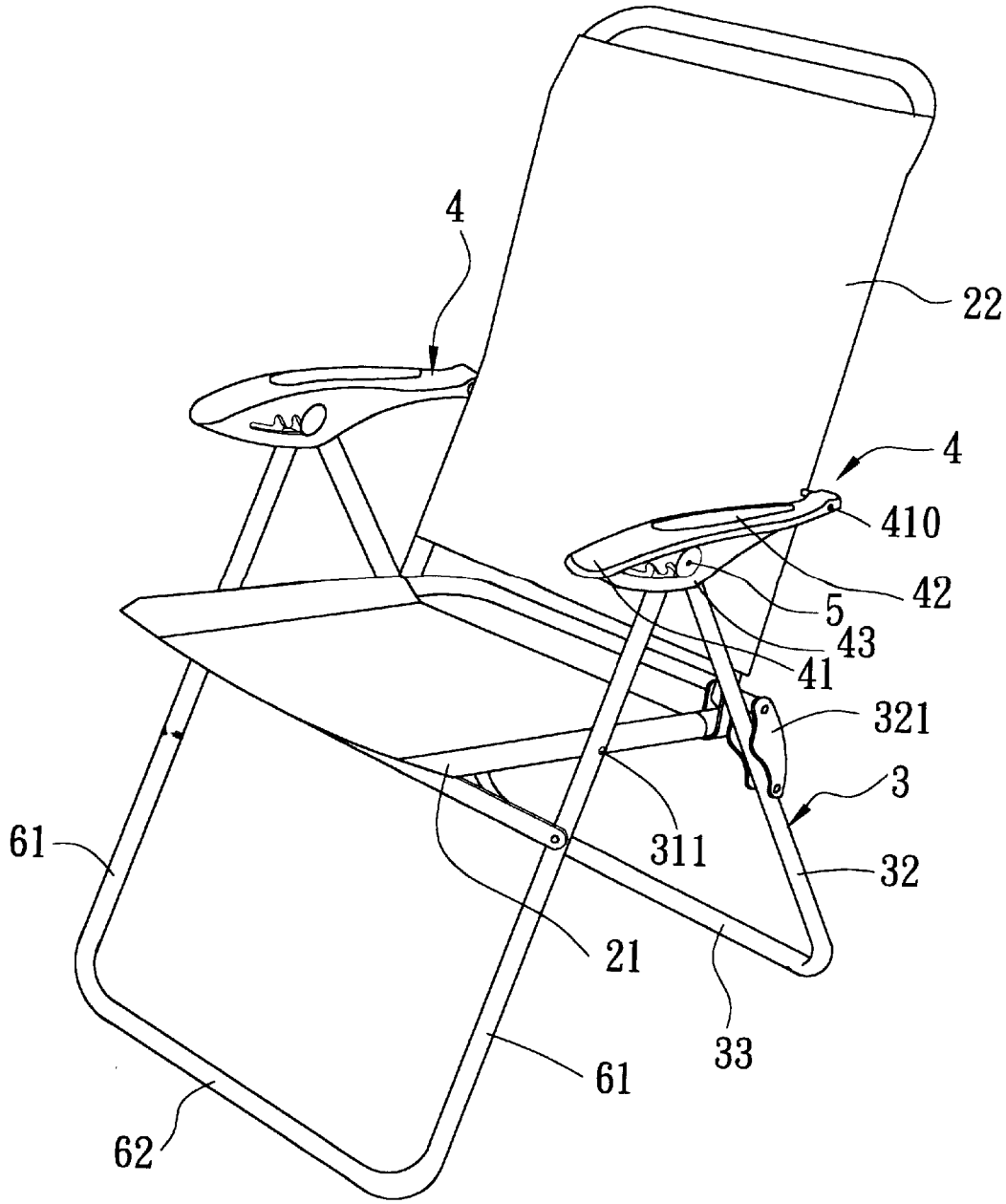
FIG. 1 is a perspective view of a preferred embodiment of the chair of the present invention.
Figure 2:
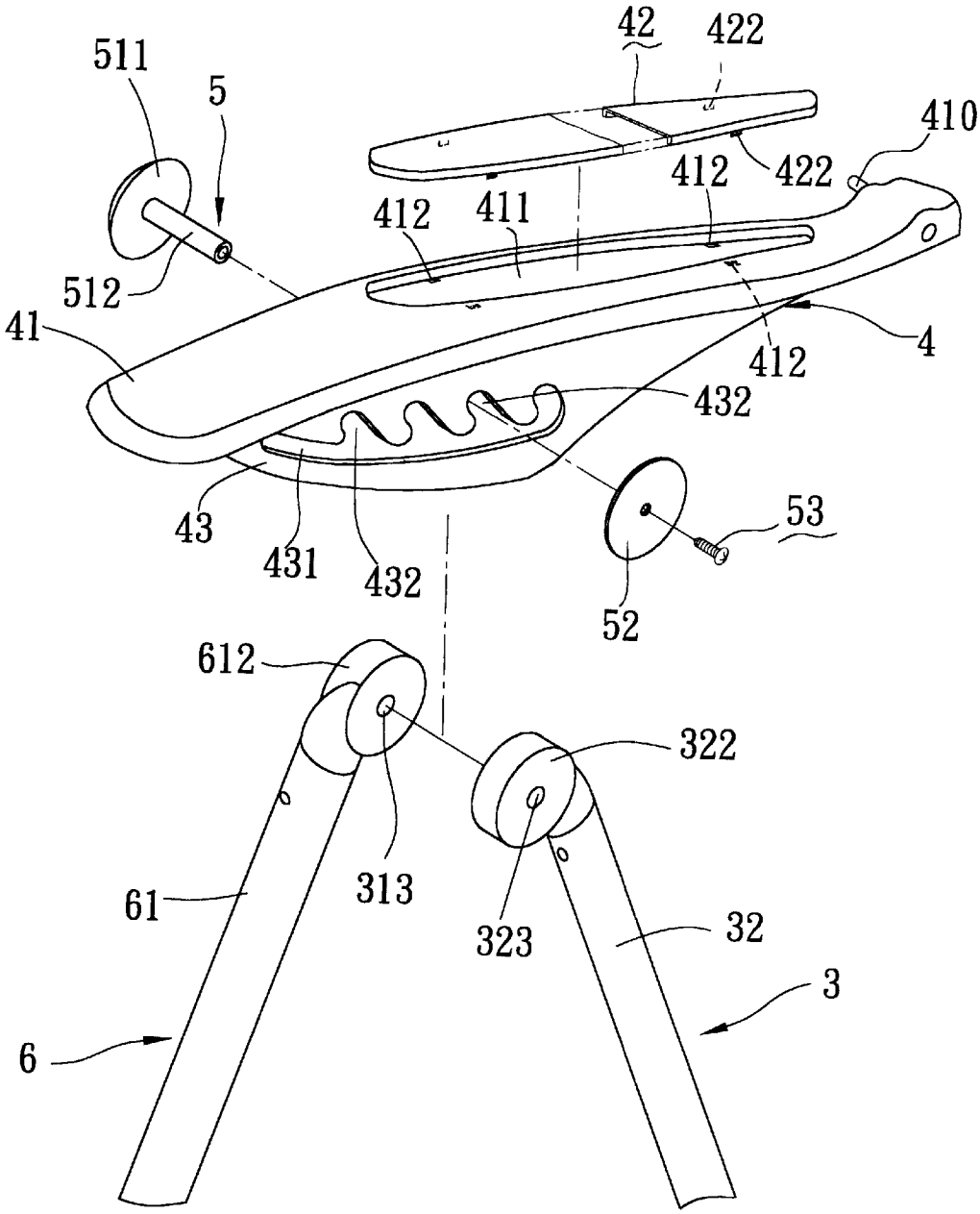
FIG. 2 is a fragmentary exploded perspective view of the preferred embodiment.

Referring to FIGS. 1 and 2, the preferred embodiment of the chair according to the present invention is shown to include a backrest member 22, a seat member 21 with a rear end portion pivoted to a lower end of the backrest member 22, a pair of armrest members 4 extending forwardly from two opposite lateral sides of the backrest member 22, and front and rear supports 31, 32 adapted for supporting the chair on a ground surface.

Figure 3:
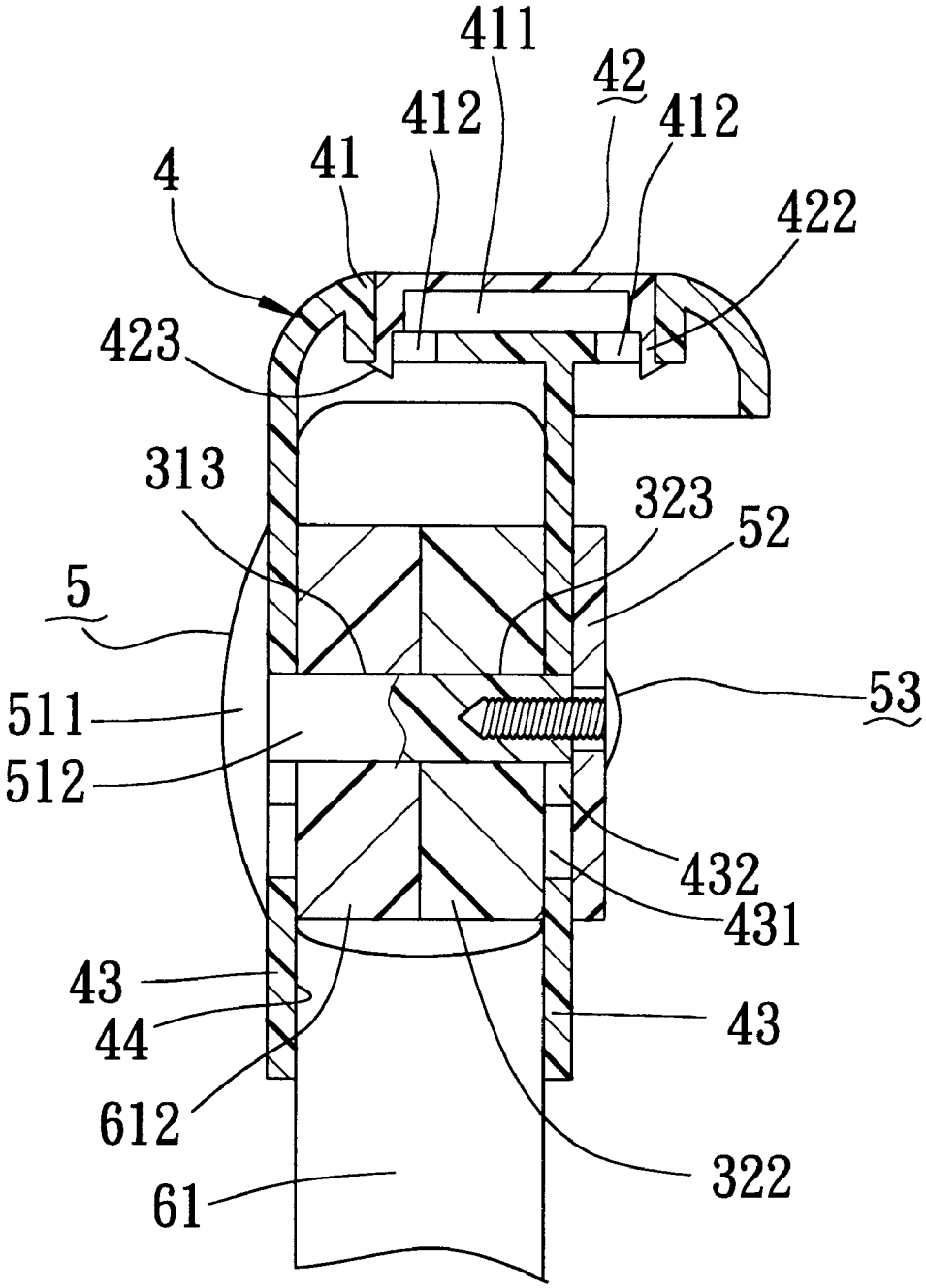
FIG. 3 is a fragmentary sectional view of the preferred embodiment.

The armrest members 4 are disposed respectively on the two lateral sides of the backrest member 22, and have rear ends pivoted to the backrest member 22 by means of a pair of horizontal pivot pins 410. Referring to FIGS. 2 and 3, each of the armrest members 4 has an outer wall surface formed with a mounting recess 411. In the present embodiment, the mounting recess 411 is formed in a top side of a top wall 41 of the respective armrest member 4. The top wall 41 is formed with a plurality of rectangular engaging holes 412 within the mounting recess 411. Each of the armrest members 4 further has a decorative face panel 42 disposed fittingly and detachably in the mounting recess 411. The top wall 41 and the face panel 42 are each formed from a plastic material. The face panel 42 is formed with a plurality of downward protrusions 422 which extend downwardly through the engaging holes 412, respectively. Each of the downward protrusions 422 has a hooked distal end 423 for engaging releasably a bottom side of the top wall 41. In the present embodiment, the face panel 42 has an inverted U-shaped cross-section, and may be provided with a label for indicating purposes. Preferably, the face panel 42 is in a color different from that of the top wall 41, or is made from a material different from that of the top wall 41 so as to provide a different feeling of touch. Alternatively, the face panel 42 may be formed from a transparent plastic material, and a decorative piece (not shown) may be disposed within the mounting recess 411 between the face panel 42 and the top wall 41 so as to be visible through the face panel 42.

Each of the armrest members 4 further has a parallel pair of positioning plates 43 which extend downwardly from the top wall 41. The positioning plates 43 extend in a longitudinal direction of the armrest member 4, and are spaced-apart in a transverse direction that is transverse to the longitudinal direction so as to define a downwardly opening longitudinal channel 44 therebetween. Each of the positioning plates 43 is formed with a plurality of locking grooves 432 that are displaced from one another in the longitudinal direction, and a slide slot 431 formed below and communicated with the locking grooves 432. The locking grooves 432 are inclined forwardly and upwardly from the slide slot 431. The slide slot 431 extends in the longitudinal direction of the respective armrest member 4. The slide slot 431 and the locking grooves 432 in one of the positioning plates 43 are aligned respectively with the slide slot 431 and the locking grooves 432 in the other one of the positioning plates 43.

The front support 6 includes two forwardly and downwardly inclined front legs 61 disposed on two opposite lateral sides of the seat member 21. The front legs 61 have lower ends connected to each other by a front cross-bar 62 that is adapted to be disposed on a ground surface, upper ends 612 extending toward the armrest members 4, respectively, and intermediate sections pivoted to a front end portion of the seat member 21 by means of a pair of pivot pins 311. The rear support 3 includes two rearwardly and downwardly inclined rear legs 32 disposed respectively on the lateral sides of the seat member 21. The rear legs 32 have lower ends connected to each other by means of a rear cross-bar 33 which is adapted to be disposed on the ground surface, upper ends 322 extending toward the armrest members 4, respectively, and intermediate sections pivoted to the rear end portion of the seat member 21 by means of a pair of known pivot connectors 321.

The upper ends 612, 322 of the front and rear legs 61, 32 are each formed as a circular disc with a pin hole 313, 323 formed therethrough. The upper ends 612, 322 of the front and rear legs 61, 32 that are disposed at the respective one of the lateral sides of the seat member 21 extend into the longitudinal channel 44 of an adjacent one of the armrest members 4, and are connected to each other by means of a connecting pin unit 5 which includes a pin portion 512 extending through the pin holes 313, 323, an enlarged head portion 511 secured to one end of the pin portion 512, and a cover plate 52 fastened to an opposite end of the pin portion 512 by means of a screw member 53. The pin portion 512 extends through the slide slots 431 in the positioning plates 43 of a respective one of the armrest members 4. The enlarged head portions 511 and the cover plate 52 are disposed on two opposite lateral sides of the positioning plates 43. The pin portion 512 is extendible into a selected one of the locking grooves 432 to permit adjustment in tilt of the backrest member 22.

Figure 4:
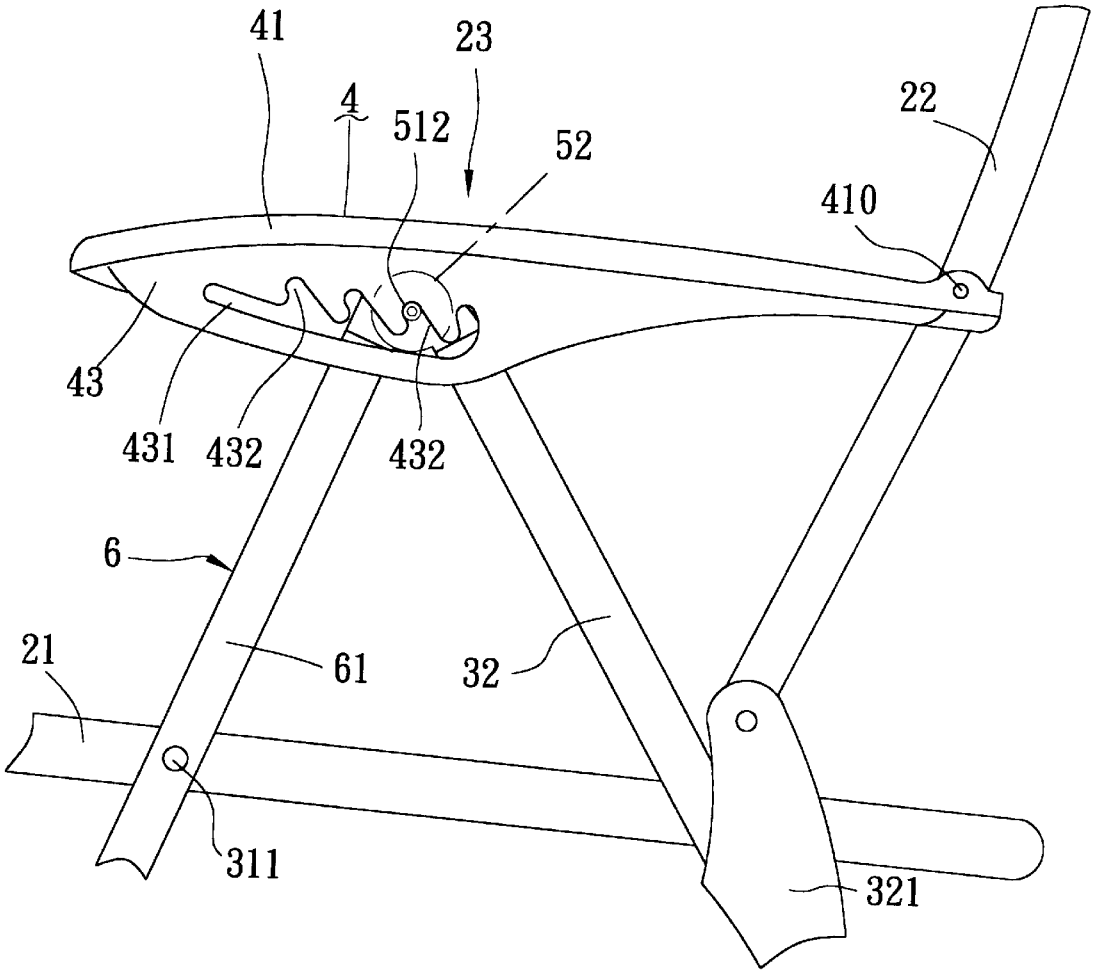
FIG. 4 is a fragmentary side view of the preferred embodiment.

Referring to FIG. 4, to adjust the tilt of the backrest member 22, the armrest members 4 are lifted to dispose the pin portions 512 in the slide slots 431. Then, the armrest members 4 are moved forwardly or downwardly so as to enable the backrest member 22 to turn forward or rearward relative to the seat member 21 and so as to slide the pin portions 512 along the slide slots 431. When the backrest member 22 is disposed at a desired inclination, the armrest members 4 are pushed downward to enable each of the pin portions 512 to extend into a selected pair of the locking grooves 432 in the respective armrest member 43, thereby positioning the backrest member 22 at the desired inclination.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A chair comprising:

a backrest member having opposite lateral sides, upper and lower ends, and an intermediate portion between said upper and lower ends;

a seat member having a rear end pivoted to said lower end of said backrest member;

a pair of armrest members disposed on said lateral sides of said backrest member, each of said armrest members having a rear end pivoted to said intermediate portion of said backrest member, and an outer wall surface formed with a mounting recess, each of said armrest members including a face panel disposed fittingly and detachably in said mounting recess;

a front support having a pair of front legs disposed respectively on said lateral sides of said seat member, each of said front legs having a lower end adapted to be supported on a ground surface, an upper end connected to a respective one of said armrest members, and an intermediate portion connected to said front end portion of said seat member; and a rear support having a pair of rear legs disposed respectively on said lateral sides of said rear support, each of said rear legs having a lower end adapted to be supported on the ground surface, an upper end connected to a respective one of said armrest members, and an intermediate portion connected to said rear end portion of said seat member; and wherein each of said armrest members has a pair of downwardly extending positioning plates which are spaced apart from each other in a transverse direction transverse to a longitudinal direction of said armrest member, each of said positioning plates being formed with a plurality of locking grooves which are displaced from one another in the longitudinal direction, and a slide slot extending in the longitudinal direction, said slide slot being formed below and being communicated with said locking grooves in a respective one of said positioning plates, said locking grooves in one of said positioning plates being aligned respectively with said locking grooves in the other one of said positioning plates, said slide slot in one of said positioning plates being aligned with said slide slot in the other one of said positioning plates, said chair further comprising a pair of connecting pin units extending in the transverse direction, each of said connecting pin units extending through said upper ends of an adjacent pair of said front and rear legs that are disposed on a respective one of said lateral sides of said seat member, each of said connecting pin units further extending through said slide slots in a respective one of said armrest members, said armrest members being movable in said longitudinal direction so as to enable said connecting pin units to slide along said slide slots for moving into and engaging a selected pair of said locking grooves, thereby permitting adjustment in tilt of said backrest member.

2. The chair as claimed in claim 1, wherein each of said armrest members has a top wall with a top side formed with said mounting recess, and a bottom side opposite to said top side.

3. The chair as claimed in claim 2, wherein said top wall of each of said armrest members is formed with a plurality of engaging holes in said mounting recess, said face panel having a plurality of downward protrusions which extend downwardly through said engaging holes for engaging the respective one of said armrest members.

4. The chair as claimed in claim 3, wherein each of said downward protrusions has a hooked distal end for engaging said bottom side of said top wall of the respective one of said armrest members.

5. The chair as claimed in claim 1, wherein each of said connecting pin units includes a pin portion extending through said upper ends of the adjacent pair of said front and rear legs, an enlarged head portion secured to one end of said pin portion, and a cover plate fastened to an opposite end of said pin portion, said enlarged head portion and said cover plate being disposed on two opposite lateral sides of the respective one of said armrest members.

* * * * *